US008995900B2

(12) United States Patent
Shindo et al.

(10) Patent No.: US 8,995,900 B2
(45) Date of Patent: Mar. 31, 2015

(54) CLEANING MEMBER, CLEANING DEVICE, PROCESS CARTRIDGE AND IMAGE FORMING APPARATUS

(75) Inventors: Kenji Shindo, Yokohama (JP); Masao Uyama, Mishima (JP); Masaki Ojima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/131,060

(22) PCT Filed: Aug. 29, 2012

(86) PCT No.: PCT/JP2012/072528

§ 371 (c)(1),
(2), (4) Date: Jan. 6, 2014

(87) PCT Pub. No.: WO2013/032023

PCT Pub. Date: Mar. 7, 2013

(65) Prior Publication Data

US 2014/0153989 A1 Jun. 5, 2014

(30) Foreign Application Priority Data

Aug. 30, 2011 (JP) ..... 2011-187328

(51) Int. Cl.
*G03G 21/00* (2006.01)
*G03G 15/08* (2006.01)
(Continued)

(52) U.S. Cl.
CPC ..... *G03G 21/0029* (2013.01); *G03G 15/0896* (2013.01); *G03G 15/161* (2013.01); *G03G 15/6529* (2013.01); *G03G 21/0011* (2013.01)
USPC ..... 399/351; 399/350

(58) Field of Classification Search
USPC ..... 399/111, 123, 343, 350, 351
See application file for complete search history.

(56) References Cited

U.S. PATENT DOCUMENTS 4,465,362 A 8/1984 Tohma et al.
4,812,878 A 3/1989 Kaieda
(Continued)

FOREIGN PATENT DOCUMENTS

GB 2135937 A 9/1984
JP 59-208569 A 11/1984
(Continued)

OTHER PUBLICATIONS

Office Action dated Jun. 24, 2013, in Japanese Patent Application No. 2011-187328.

*Primary Examiner* — Hoan Tran
(74) *Attorney, Agent, or Firm* — Fitzpatrick, Cella, Harper & Scinto

(57) ABSTRACT

A cleaning member includes a blade portion contacted to a member-to-be-cleaned with respect to a direction counter to a movement direction of the member-to-be-cleaned, and a flexible supporting member. The supporting member includes one end portion where the blade portion is provided, another end portion including a portion-to-be-fixed for being fixed at the fixing portion, and a bent portion between the one end portion and the other end portion in a side remote from a surface of the member-to-be-cleaned toward an outside with respect to a line connecting the portion-to-be-fixed and a contact portion where the blade portion is contacted to the member-to-be-cleaned. The portion-to-be-fixed is provided downstream of the contact portion with respect to the movement direction of the member-to-be-cleaned. The blade portion is supported by the supporting member in contact to only the one end portion.

33 Claims, 11 Drawing Sheets

(51) Int. Cl.
*G03G 15/16* (2006.01)
*G03G 15/00* (2006.01)

(56) References Cited

U.S. PATENT DOCUMENTS

| | | | | |
|---|---|---|---|---|
| 6,701,123 | B2 * | 3/2004 | Endo et al. | 399/350 |
| 7,065,317 | B2 | 6/2006 | Suda | |
| 7,139,502 | B2 | 11/2006 | Koishi et al. | |
| 7,158,749 | B2 * | 1/2007 | Ueno et al. | 399/351 |
| 7,352,989 | B2 | 4/2008 | Suda | |
| 7,627,269 | B2 | 12/2009 | Matsuguma et al. | |
| 7,817,954 | B2 * | 10/2010 | Yano et al. | 399/349 |
| 2004/0141781 | A1 | 7/2004 | Suda | |
| 2005/0254868 | A1 | 11/2005 | Naruse et al. | |
| 2014/0153990 | A1 | 6/2014 | Oka et al. | |

FOREIGN PATENT DOCUMENTS

| | | | |
|---|---|---|---|
| JP | 63-129386 | A | 6/1988 |
| JP | 06-95502 | A | 4/1994 |
| JP | 7-306621 | A | 11/1995 |
| JP | 2002-341721 | A | 11/2001 |
| JP | 2004-177935 | A | 6/2004 |
| JP | 2005-321438 | A | 11/2005 |
| WO | 2011/071180 | A1 | 6/2011 |

* cited by examiner (a)

EMB. 1

(b)

COMP. EMB. 1

(a)

EMB. 1

(b)

COMP. EMB. 1

CLEANING MEMBER, CLEANING DEVICE, PROCESS CARTRIDGE AND IMAGE FORMING APPARATUS

TECHNICAL FIELD

The present invention relates to a cleaning member for removing a developer from a surface of an image bearing member, a cleaning device, a process cartridge and an image forming apparatus.

Here, as the image forming apparatus, e.g., an electrophotographic copying machine, a laser beam printer, an LED printer, a facsimile machine and the like are included. Further, the process cartridge refers to a cartridge prepared by integrally assembling at least image bearing member and the cleaning device so as to be detachably mountable to the image forming apparatus.

BACKGROUND ART

In the electrophotographic image forming apparatus, a cleaning blade type as a cleaning means for removing, in order to repetitively use the image bearing member, the developer remaining on the image bearing member after transferring a developer image from the image bearing member onto a recording material (medium) has been known.

The cleaning type is a method in which a blade having elasticity is contacted to the surface of the image bearing member at a predetermined pressure to remove the developer from the surface of the image bearing member.

In Japanese Laid-Open Patent Application (JP-A) 2002-341721, the cleaning member has a structure in which a blade is mounted by molding at an end of a metal plate as a supporting member. Further, the metal plate is secured to a frame by a screw or the like to fix the cleaning member, so that the cleaning member is contacted to the surface of the image bearing member at the predetermined pressure.

However, the image forming apparatus such as the printer tends to be downsized, increased in speed and improved in image quality with popularization thereof. When the image forming apparatus is downsized, a size of the image bearing member becomes small. Further, by the speed-up, the image bearing member is quickly rotated. That is, the blade contacted to the image bearing member surface repetitively slides on the image bearing member surface at high speed. Then, a temperature of the blade itself is increased, so that hardness of the blade is decreased. As a result, a frictional force between the image bearing member surface and the blade is increased. Thus, there can arise a problem of an increase in driving torque for driving the image bearing member and turning-up of the blade. Further, in recent years, a spherical developer is used in order to improve the image quality. In this case, in order to remove the developer from the image bearing member surface, there is a need to increase a contact pressure of the blade to the image bearing member, thus constituting one of factors which accelerate the above-described problem.

SUMMARY OF THE INVENTION

The present invention has been accomplished in order to solve the above-described problem of the prior art. A principal object of the present invention is to provide a cleaning member, a cleaning device, a process cartridge and an image forming apparatus which are capable of suppressing an increase in driving torque and turning-up of a blade when an image bearing member is driven.

According to an aspect of the present invention, there is provided a cleaning member, to be fixed at a fixing portion, for removing a developer from a surface of a member to be cleaned, the cleaning member comprising: a blade portion contacted to the member to be cleaned with respect to a counter direction to a movement direction of the member to be cleaned; and a flexible supporting member for supporting the blade portion, the supporting member comprising one end portion where the blade portion is provided, another end portion including a portion to be fixed for being fixed at the fixing portion, and a bent portion between the one end portion and the another end portion in a side remote from a surface of the member to be cleaned toward an outside with respect to a line connecting the portion to be fixed and a contact portion where the blade portion is contacted to the member to be cleaned, wherein the portion to be fixed is provided downstream of the contact portion with respect to the movement direction of the member to be cleaned, and wherein the blade portion is supported by the supporting member in contact to only the one end portion.

According to another aspect of the present invention, there is provided a cleaning member, to be fixed at a fixing portion, for removing a developer from a surface of a member to be cleaned, the cleaning member comprising: a blade portion contacted to the member to be cleaned with respect to a counter direction to a movement direction of the member to be cleaned; and a flexible curved supporting member for supporting the blade portion, the supporting member comprising a blade portion supporting portion where the blade portion is provided in its end side, a portion to be fixed for being fixed at the fixing portion, and a bent top between the blade portion supporting portion and the portion to be fixed in a side remote from a surface of the member to be cleaned toward an outside with respect to a line segment connecting the portion to be fixed and a contact portion where the blade portion is contacted to the member to be cleaned, wherein the portion to be fixed is provided downstream of the contact portion with respect to the movement direction of the member to be cleaned, and wherein the blade portion is supported by the supporting member in contact to only the blade portion supporting portion.

These and other objects, features and advantages of the present invention will become more apparent upon a consideration of the following description of the preferred embodiments of the present invention taken in conjunction with the accompanying drawings.

Figure 7:
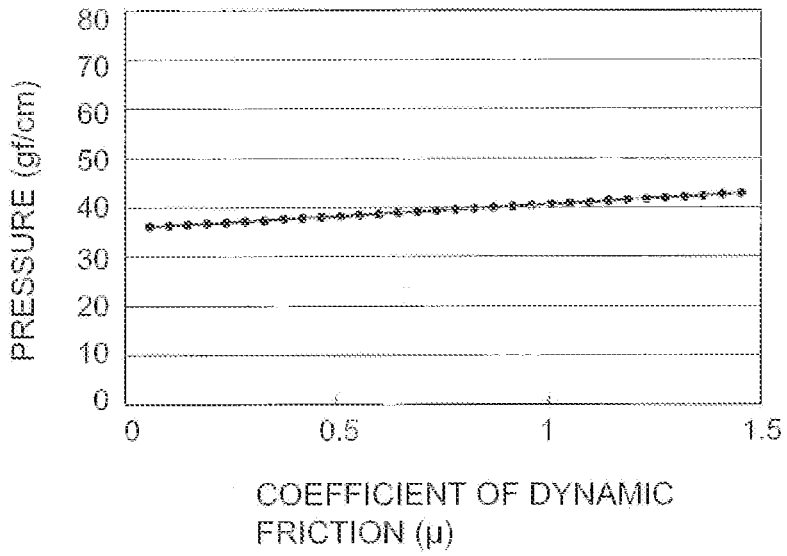
Figure 7:
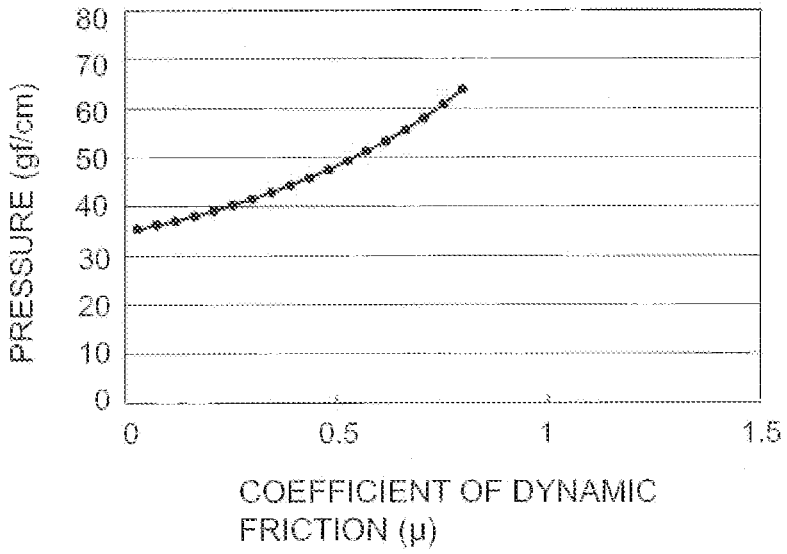

Parts (a) and (b) of FIG. 7 are graphs each showing a result of simulation calculation of a relationship between a coefficient of dynamic friction and a cleaning device.

Figure 8:
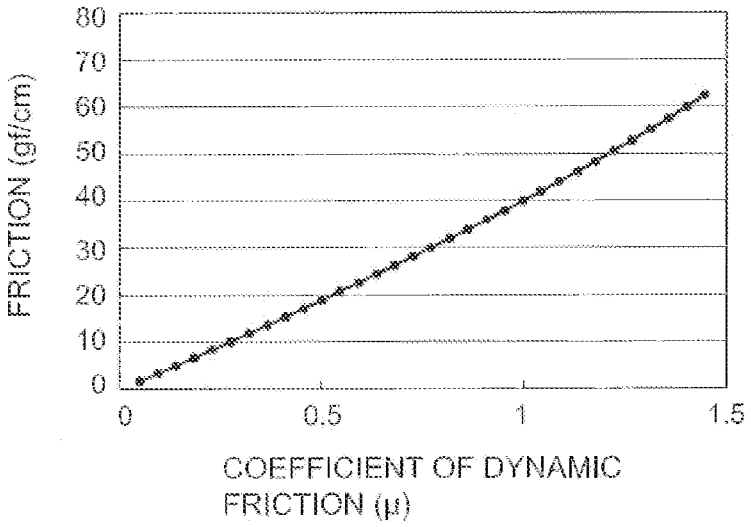
Figure 8:
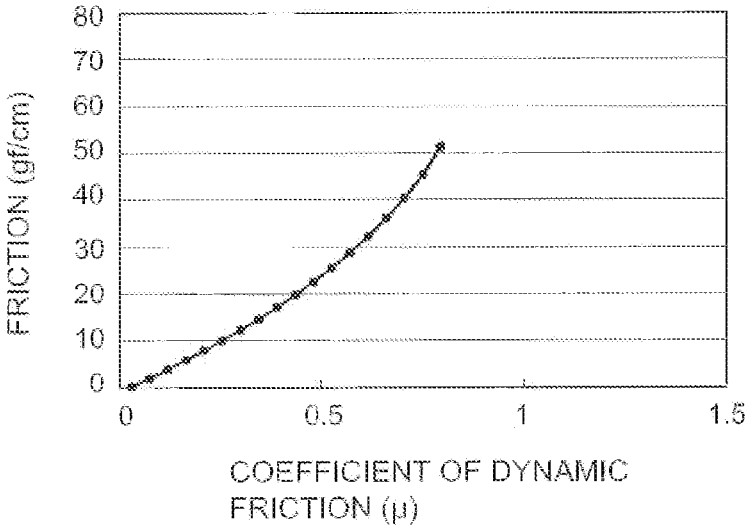

Parts (a) and (b) of FIG. 8 are graphs each showing a result of simulation calculation of a relationship between a coefficient of dynamic friction and a frictional force.

Figure 9:
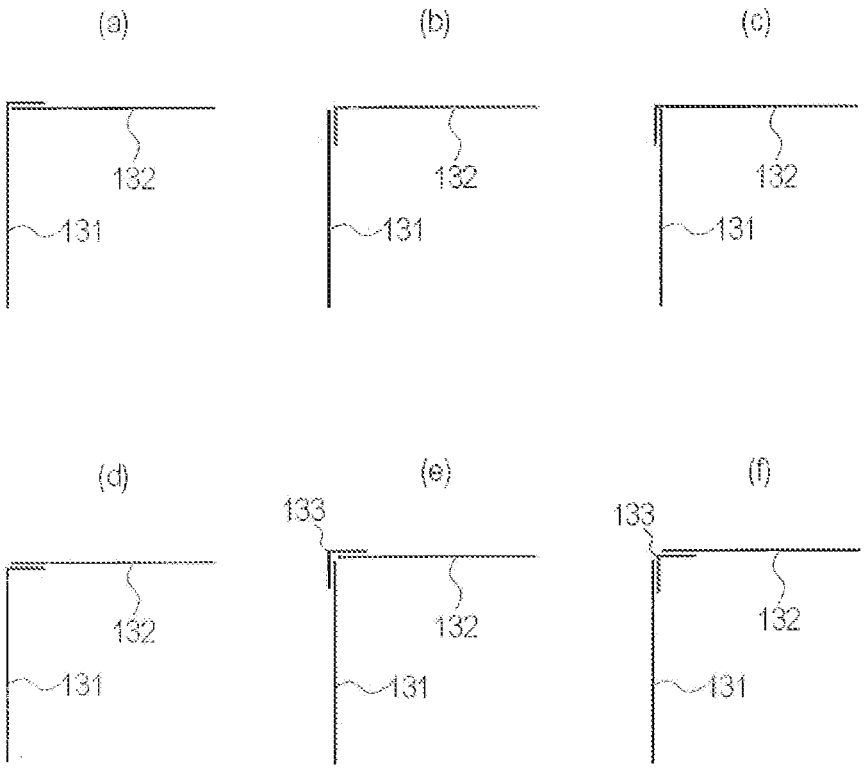

Parts (a) to (f) of FIG. 9 are modified examples of a supporting member for the cleaning member in Embodiment 1.

Figure 10:
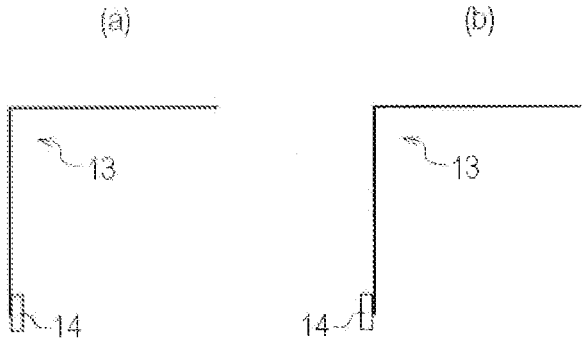

Parts (a) and (b) of FIG. 10 are modified examples of a blade of the cleaning member in Embodiment 1.

Figure 11:
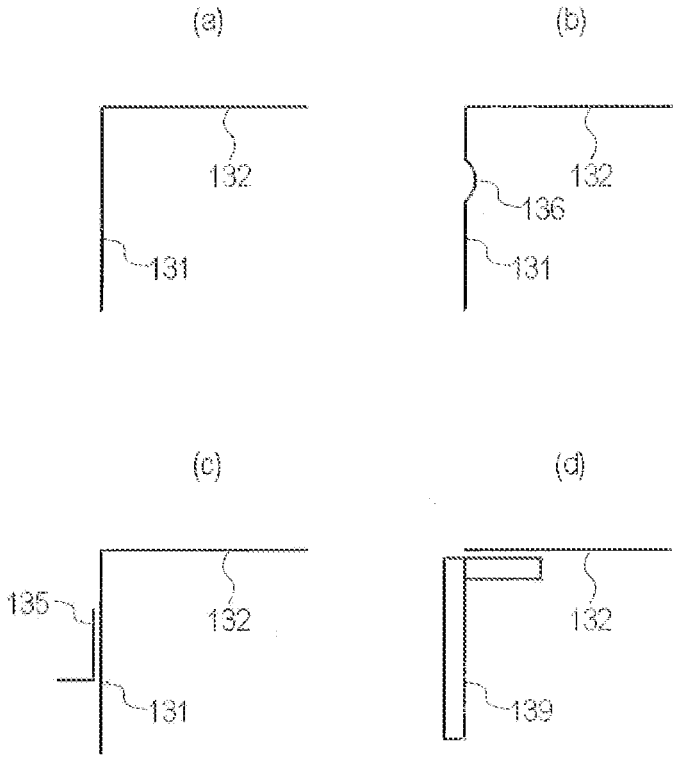

Parts (a) and (d) of FIG. 11 are examples of a supporting member for a cleaning member in Embodiment 2.

Figure 12:
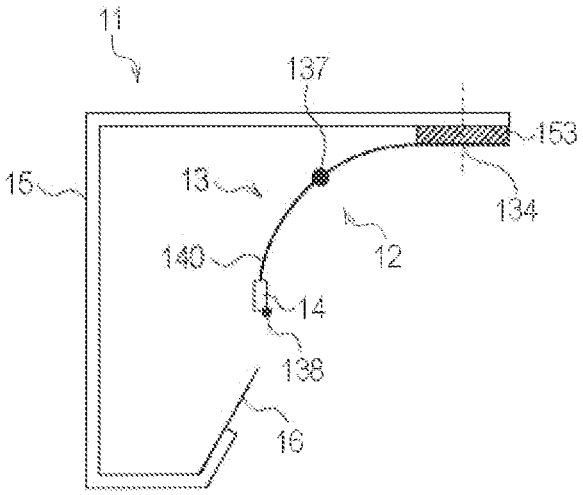

FIG. 12 is a schematic illustration of a cleaning device in Embodiment 3.

Figure 13:
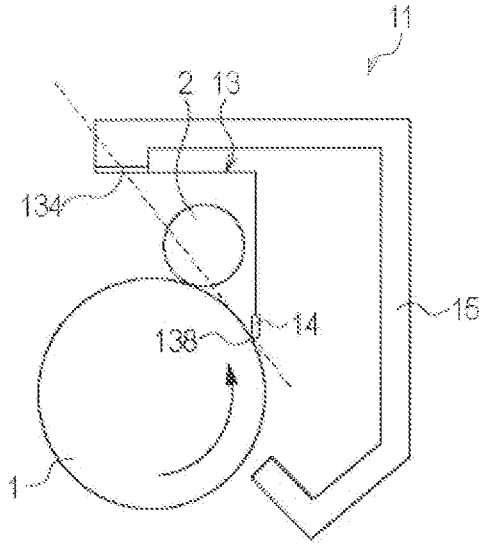

FIG. 13 is a schematic illustration of a cleaning device in Embodiment 4.

Figure 14:
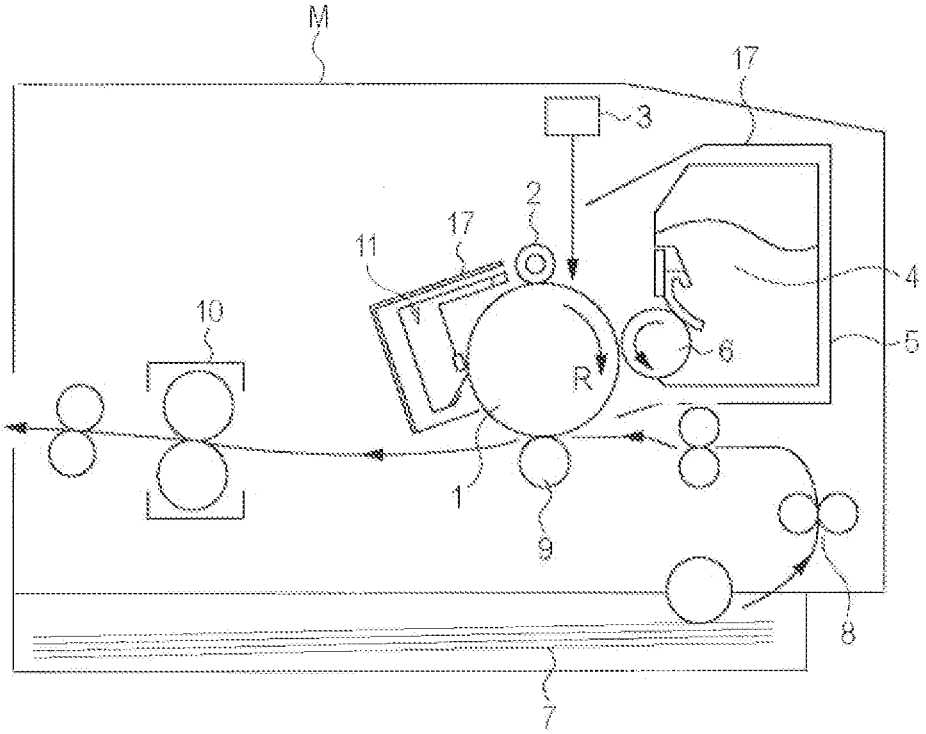

FIG. 14 is a schematic illustration of an example of an image forming apparatus in Embodiment 1.

Figure 15:
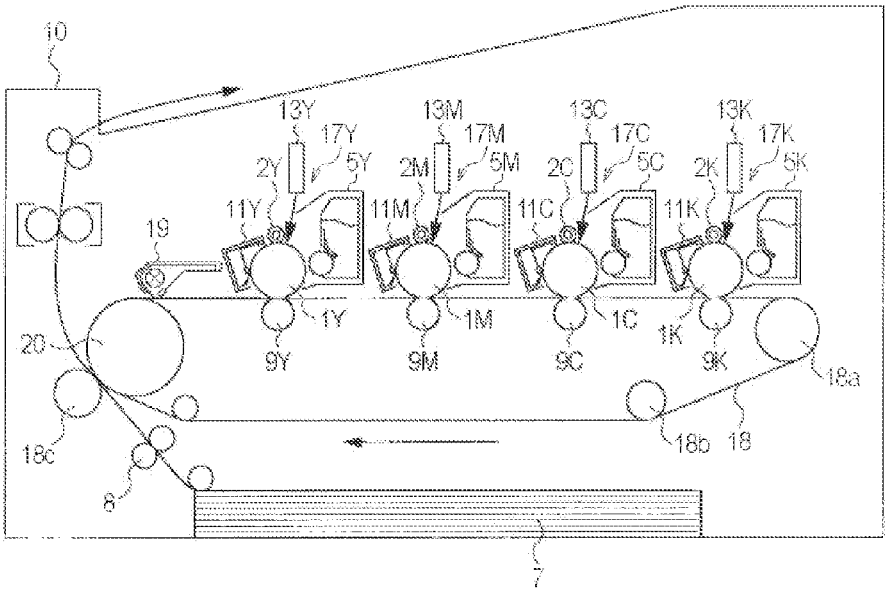

FIG. 15 is a schematic illustration of an example of a color image forming apparatus of a tandem type in Embodiment 1.

Figure 16:
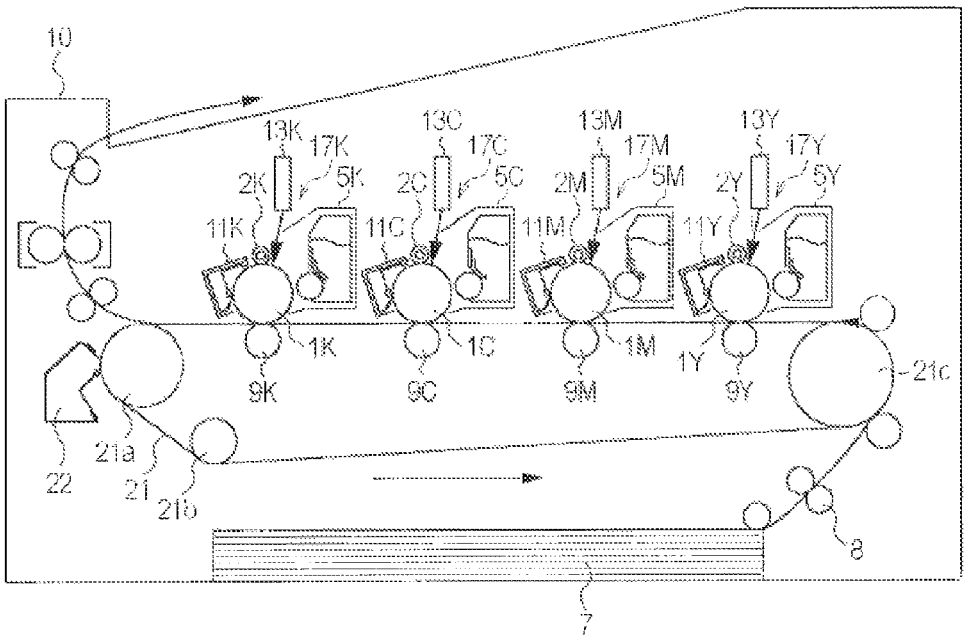

FIG. 16 is a schematic illustration of an example of an image forming apparatus including a recording material conveying member in Embodiment 1.

Figure 17:
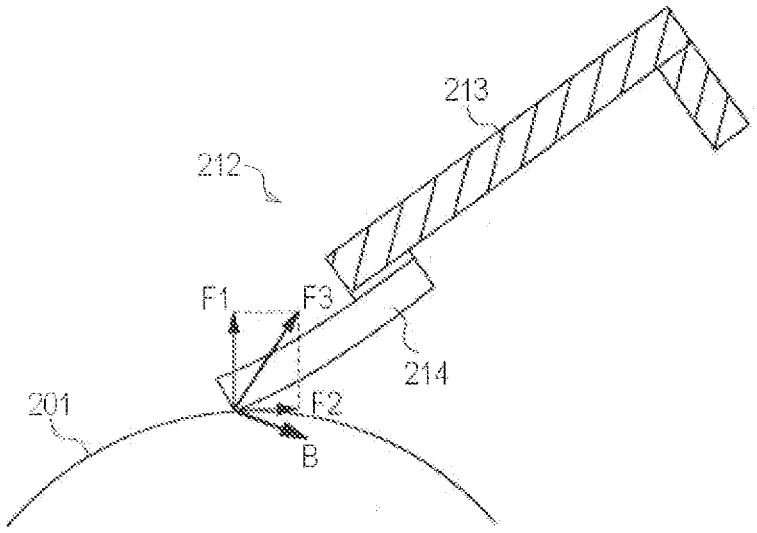

FIG. 17 is a schematic illustration of a cleaning member in a Comparative Embodiment.

Figure 18:
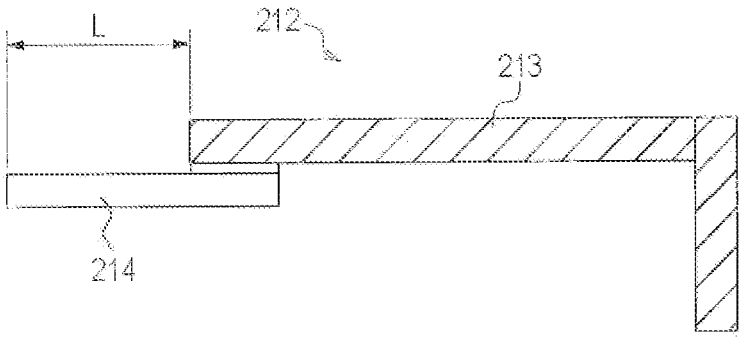

FIG. 18 is a detailed structural view of the cleaning member in a Comparative Embodiment.

EMBODIMENTS FOR CARRYING OUT THE INVENTION

Embodiment 1

An example of an image forming apparatus according to this embodiment will be described. The image forming apparatus shown in FIG. 14 is a monochromatic laser beam printer of an electrophotographic type, and FIG. 14 is a schematic illustration of the image forming apparatus.

In the neighborhood of a substantially central portion of a main assembly M of the image forming apparatus, a drum-type photosensitive drum 1 as an image bearing member (member to be charged) is provided. The photosensitive drum 1 is prepared by forming an OPC (organic photoconductor (optical semiconductor)) photosensitive layer on an outer peripheral surface of an electroconductive drum support of aluminum or the like. The photosensitive drum 1 is rotationally driven in an arrow R direction at a predetermined process speed of 200 mm/sec.

The surface (peripheral surface) of the photosensitive drum 1 is electrically charged uniformly to a predetermined polarity and a predetermined potential by a charging roller 2 as a charging member. The surface of the photosensitive drum 1 after the charging is subjected to scanning exposure to a laser beam, outputted from a laser beam scanner 3 as an exposure means, modulated correspondingly to a time-series electric digital pixel signal of objective image information. Then, an electrostatic latent image corresponding to the objective image information is formed. On this electrostatic latent image, a toner (developer) 4 conveyed by a developing sleeve 6 of a developing device 5 is deposited, so that the latent image is developed as a toner image (developer image).

A recording material 7 is fed by a sheet feeding roller 8 and is sent to a transfer nip between the photosensitive drum 1 and a transfer roller 9 so as to be synchronized with the toner image formed on the photosensitive drum 1, so that the toner image is transferred onto the surface of the recording material 7. To the transfer roller 9, a transfer bias for transfer is applied from a transfer bias applying power (voltage) source (not shown) during the transfer. The recording material 7 subjected to the toner image transfer is separated from the surface of the photosensitive drum 1 and then is conveyed to a fixing device 10, where the toner image is heated and pressed to be fixed on the surface of the recording material 7.

On the other hand, the photosensitive drum 1 after the toner image transfer is subjected to removal of a residual toner, remaining on the surface thereof without being transferred onto the recording material 7, by a cleaning device 11 as a cleaning means, and then is subjected to subsequent image formation.

Further, this embodiment is also applicable to cleaning of an image forming apparatus capable of forming a color image. FIG. 15 shows an example of a color image forming apparatus of a tandem type. The color image forming apparatus is a color laser printer using a transfer type, an electrophotographic process, a contact charging type, a reverse development type, and A3 size as a maximum sheet passing size. The color image forming apparatus is a 4-drum type (in-line) printer in which a plurality of process cartridges 17 are provided and color toner images are once successively transferred superposedly onto an intermediary transfer belt 18 as an intermediary transfer member which is a second image bearing member (image carrying member) to obtain a full-color print image.

In FIG. 15, the endless intermediary transfer belt 18 is stretched by a driving roller 18*a*, a tension roller 18*b* and a secondary transfer opposite roller 18*c* and is rotationally driven in an arrow direction indicated in the figure at a predetermined process speed of 300 mm/sec. Four process cartridges 17 are disposed in line with the intermediary transfer belt 18 in the order of those for yellow 17Y, magenta 17M, cyan 17C and black 17K.

In the color image forming apparatus of the tandem type, four cleaning devices (11Y, 11M, 11C, 11K) are provided and therefore a driving torque generated during drive of photosensitive drums (1Y, 1M, 1C, 1K) is large. However, when the constitution of this embodiment is applied, a reducing effect of the driving torque becomes large.

Further, as shown in FIG. 15, this embodiment is also applicable to an intermediary transfer cleaner 19 for removing the toner 4 remaining on the intermediary transfer belt 18 behind a secondary transfer 20. In this embodiment, a constitution in which the toner 4 collected by the intermediary transfer belt cleaner 19 is conveyed to a residual toner collecting container (not shown) by a screw is employed.

Further, this embodiment is also applicable as a cleaning device for a transfer and conveyance belt 21 which is a conveying member for conveying the recording material P and for transferring the toner image from the photosensitive drum 1. FIG. 16 shows an example of a color image forming apparatus of a tandem type including the transfer and conveyance belt 21. In FIG. 16, the endless transfer and conveyance belt 21 is stretched by a driving roller 21*a*, a tension roller 21*b* and a follower roller 21*c* and is rotationally driven in an arrow direction indicated in the figure at a predetermined process speed of 300 mm/sec. Four process cartridges 17 are disposed in line with the transfer and conveyance belt 21 in the order of those for yellow 17Y, magenta 17M, cyan 17C and black 17K. The recording material 7 is conveyed by the transfer and conveyance belt 21 and onto which toner images formed on photosensitive drums (1Y, 1M, 1C, 1K) are successively transferred by transfer rollers (9Y, 9M, 9C, 9K). On the photosensitive drums (1Y, 1M, 1C, 1K), a fog toner is present, and the surface of the transfer and conveyance belt 21 is contaminated with the fog toner during an interval of adjacent recording materials 7. This fog toner is collected by a transfer and conveyance belt cleaner 22.

The cleaning member 12 according to the present invention will be described.

Figure 1:
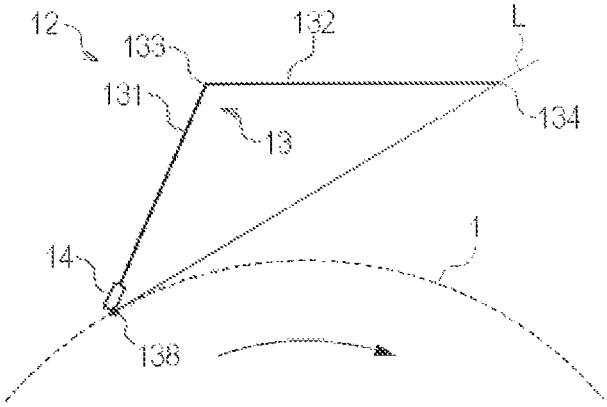
FIG. 1 is a schematic illustration of a cleaning member in Embodiment 1.

FIG. 1 is a schematic illustration of the cleaning member 12 in this embodiment. The cleaning member 12 is fixed at a fixing portion and removes the toner 4, remaining after the transfer, from the photosensitive drum 1 which is a member to be cleaned. The cleaning member 12 is constituted by a blade 14 contacted to the photosensitive drum 1 in a counter direction to a movement direction (the arrow direction in FIG. 1) of the photosensitive drum 1, and a flexibility supporting member 13 for supporting the blade 14.

The supporting member 13 is constituted by one end portion 131 where the blade 14 is provided, another end portion 132 including a portion to be fixed 134 fixed at the fixing portion, and a bent portion 133 located between the one end portion 131 and the another end portion 132. The bent portion 133 is positioned in a side where it is spaced from the surface of the photosensitive drum 1 toward an outside (in a side where the bent portion 133 is moved away from the surface of the photosensitive drum 1) with respect to a line segment L connecting the portion to be fixed 134 and a contact portion 138 where the blade 14 is contacted to the photosensitive drum 1. Further, the portion to be fixed 134 of the supporting member 13 is disposed downstream of the contact portion 138 with respect to the movement direction of the photosensitive drum 1, and the blade 14 is supported by only the one end portion 131.

By constituting the cleaning member 12 as described above, even when a frictional force between the photosensitive drum 1 and the blade 14 is increased, an abrupt increase in a contact pressure of the blade 14 can be suppressed. An action thereof will be described.

First, a cleaning member 212 as Comparative Embodiment will be described. FIG. 17 is a schematic illustration of a conventionally known cleaning member as Comparative Embodiment. A urethane rubber blade 214 which is an elastic member is supplied by a supporting member 213 having rigidity, and is contacted to a photosensitive drum 201. Then, the blade 214 having elasticity is pressed against (deformed on) the surface of the photosensitive drum 201 to obtain a contact pressure for removing the residual toner from the surface of the photosensitive drum 201.

When the photosensitive drum 201 is rotated, the blade 214 receives a force of resultant force F3 which is the resultant force between reaction F1 by the contact pressure of the blade 214 and frictional force F2 between the surface of the photosensitive drum 201 and the blade 214. When the frictional force F2 is increased, the resultant force F3 becomes large. The blade 214 has a relatively small degree of freedom with respect to a direction of the resultant force F3. Therefore, the blade 214 is deformed with respect to an arrow B direction in FIG. 17. This deformation direction is a direction in which the blade 214 enters the photosensitive drum 201 and therefore the reaction F1 becomes large. When the reaction F1 is increased, the frictional force F2 is further increased. As a result, the resistance F1 is abruptly increased. For this reason, there arose a problem of an increase in driving torque for driving the photosensitive drum 201 and turning-up of the blade 24 in some cases.

Figure 2:
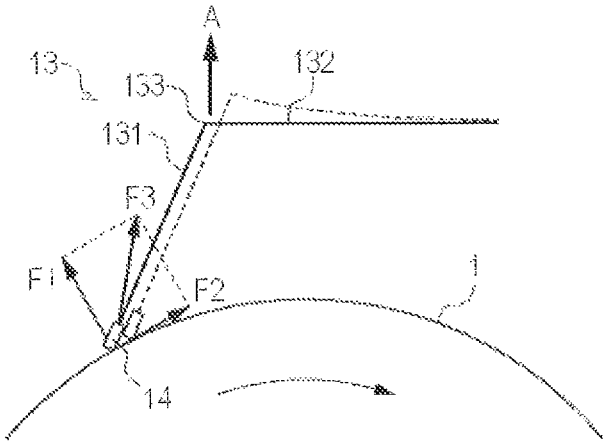
FIG. 2 is a schematic diagram showing a state in which a supporting member is deformed in Embodiment 1.

Next, the cleaning member 12 in this embodiment will be described. FIG. 2 is a schematic diagram showing a state in which the flexibility supporting member 13 is deformed when the frictional force between the surface of the photosensitive drum 1 and the blade 14 is increased.

In the cleaning member 12 in this embodiment, the flexibility supporting member 13 is pressed against (deformed on) the surface of the photosensitive drum 1 to obtain a contact pressure for removing the residual toner from the surface of the photosensitive drum 1.

When the photosensitive drum 1 is rotated, the blade 14 receives a force of resultant force F3 which is the resultant force between resistance F1 by the contact pressure of the supporting member 13 and frictional force F2 between the surface of the photosensitive drum 1 and the blade 14. With respect to this resultant force F3, the one end portion 131 has a small angle formed between itself and the resultant force F3 and therefore a degree of freedom of deformation is very small, so that the one end portion 131 is not readily deformed (i.e., thrusts). On the other hand, with respect to a direction of the resultant force F3, the another end portion 132 has a large angle formed between itself and the resultant force F3 and therefore the degree of freedom of deformation is high. Therefore, as indicated by a broken line in FIG. 2, the another end portion 132 is deformable. Further, the another end portion 132 can be deformed with respect to an arrow A direction in FIG. 2, so that the blade 14 supported by the supporting member 13 is prevented from entering the photosensitive drum 1. As a result, the increase in reaction F1 is suppressed. For this reason, the increase in driving torque for driving the photosensitive drum 1 and the turning-up of the blade 13 can be suppressed.

Incidentally, the another end portion 132 may desirably be constituted to strongly receive bending moment by the resultant force F3. Therefore, the one end portion 131 is configured so that it receives the force from the blade 14 to elastically deform the another end portion 132.

Further, it is important that the another end portion 132 can be elastically deformed with respect to the arrow A direction in FIG. 2 by the resultant force F3. Therefore, the blade 14 is provided by being supported by only the one end portion 131 so as not to extend to the bent portion 133, thus being prevented from impairing the elastic deformation (bending) of the another end portion 132.

Figure 3:
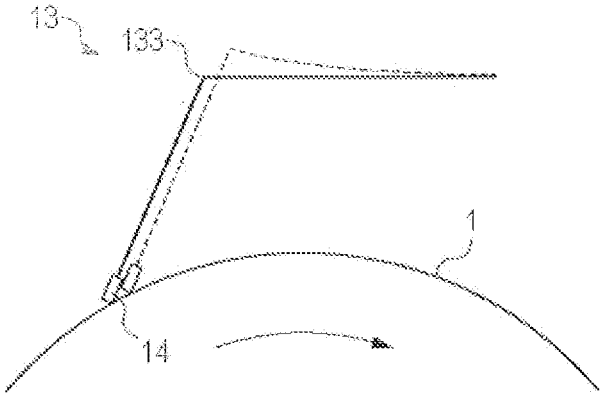
FIG. 3 is a schematic diagram showing the state in which the supporting member is deformed when a photosensitive drum is moved from a rest state.

FIG. 3 is a schematic diagram showing a state in which the supporting member 13 is deformed when the photosensitive drum 1 is moved from a rest state. It is desirable that the blade 14 supported by the supporting member 13 is prevented from further entering the photosensitive drum 1. Therefore, when the photosensitive drum 1 is moved from its rest state, it is desirable that the bent portion 133 is movable in a direction in which the bent portion 133 is moved away from the surface of the photosensitive drum 1.

As a material for the supporting member 13, it is possible to use engineering plastics such as polyacetal (POM), polycarbonate (PC) and polyphenylene sulfide (PPS). The supporting member 13 may only be required to obtain a desired cleaning contact pressure by adjusting its plate thickness, lengths of the one end portion 131 and the another end portion 132, and a penetration depth (entering amount) of the cleaning member 12 with respect to the photosensitive drum 1.

Further, as a material for the supporting member 13, it is possible to use also a spring member of metal having a spring property, such as SUS or phosphor bronze plate. Compared with the above-described engineering plastics, the metal material is advantageous in terms of productivity, cost, accuracy and the like. Further, a damping member or the like having elasticity can also be used.

Next, the cleaning device 11 will be described. The cleaning device 11 includes a cleaning container as an accommodating portion, constituted by a frame, for accommodating the toner 4 removed from the photosensitive drum 1, a fixing portion 153 provided to the cleaning container 15, and the cleaning member 12.

Figure 4:
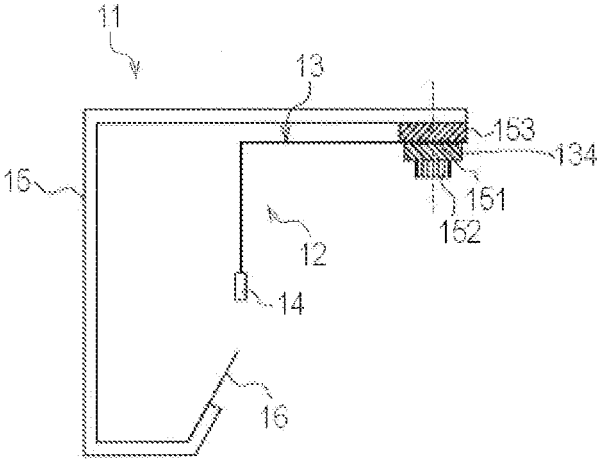
FIG. 4 is a schematic illustration of a cleaning device in Embodiment 1.

FIG. 4 is a schematic illustration of the cleaning device 11 in this embodiment.

The cleaning device 11 is constituted by the cleaning member 12, a scooping sheet 16, and the cleaning container 15. The cleaning member 12 is used for scraping off the residual toner 4 remaining on the photosensitive drum 1 after the transfer while being in contact to the surface of the photosensitive drum 1. The scooping sheet 16 is provided upstream of the cleaning member with respect to the movement direction of the photosensitive drum 1, for scooping the scraped toner 4, and is contacted to the surface of the photosensitive drum 1. The cleaning container 15 stores the scooped residual toner 4. The cleaning member 12 is fixed, on the fixing portion 153 provided to the cleaning container 15, at the portion to be fixed 134 of the supporting member 13. As an example of a fixing method of fixing the cleaning member to the cleaning container 15, as shown in FIG. 4, the cleaning member 12 is fixed via a holding member 151 via mounting screws 152 provided at several positions with respect to a longitudinal direction.

Next, the process cartridge 17, detachably mountable to the main assembly M of the image forming apparatus, including the photosensitive drum 1, the fixing portion 153 provided to the cleaning container 15 and the cleaning member 12 according to the present invention will be described.

Figure 5:
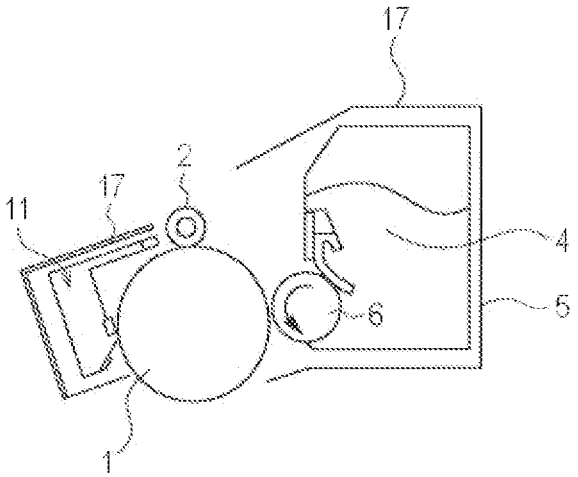
FIG. 5 is a schematic illustration of a process cartridge in Embodiment 1.

FIG. 5 is a schematic illustration of the process cartridge 17 in this embodiment. The process cartridge 17 is prepared by integrally assembling four process devices, of the photosensitive drum 1, the charging roller 2, the developing device 5 and the cleaning device 11, with a cartridge container. Further, the process cartridge 17 is constituted so as to be detachably mountable to the image forming apparatus main assembly M.

The cleaning member 12 will be described more specifically.

Figure 6:
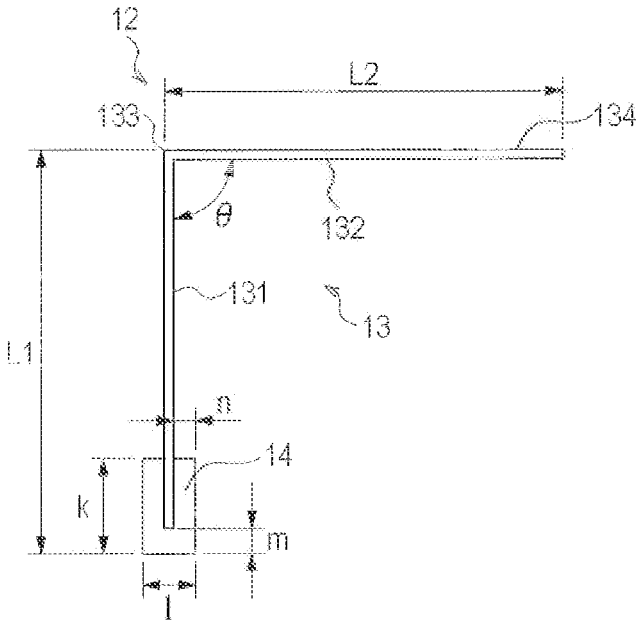
FIG. 6 is a detailed structural view of the cleaning member in Embodiment 1.

FIG. 6 is a detailed structural view of the cleaning member in this embodiment.

As described above, the cleaning member 12 is constituted by the flexibility supporting member 13 and the blade 14. The supporting member 13 is constituted by the one end portion 131 where the blade 14 is provided, the another end portion 132 including the portion to be fixed 134 fixed at the fixing portion 153 of the cleaning container 15, and the bent portion 133 located between the one end portion 131 and the another end portion 132. Further, the bent portion 133 is positioned in a side where it is spaced from the surface of the photosensitive drum 1 toward an outside with respect to a line segment connecting the portion to be fixed 134 and a contact portion 138 where the blade 14 is contacted to the photosensitive drum 1.

In this embodiment, as the material for the supporting member 13, SUS material was used. The plate thickness t of the supporting member 13 was 0.2 mm. An angle θ of the bent portion 133 shown in FIG. 6 was 90 degrees uniformly with respect to a rotational axis direction of the photosensitive drum 1. In this case, when a length of the one end portion 131 of the supporting member 13 is L1 and a length of the another end portion 132 is L2, L1 was 12 mm and L2 was 12 mm. Further, similarly as in the conventional cleaning member, a set angle between the photosensitive drum 1 and the cleaning member 12 was 30 degrees and the penetration depth was 1.05 mm.

In this case, the contact pressure of the cleaning member 12 to the photosensitive drum 1 was about 35 gf per cm with respect to the rotational axis direction of the photosensitive drum 1. For comparison, when checking was made at the set angle of 20 degrees, the contact pressure was about 30 gf per cm with respect to the rotational axis direction of the photosensitive drum 1.

Incidentally, the angle θ of the bent portion 133 is not particularly required to be 90 degrees. The angle θ may only be required to provide a predetermined contact pressure by adjusting the length L1 of the one end portion 131, the length L2 of the another end portion 132, the set angle and the penetration depth.

As the material for the blade member 14, the urethane rubber was used. The blade 14 had JIS-A hardness of 70 degrees. It is desirable that a degree of deformation of the blade member 14 itself is decreased and a force of the one end portion 131 for elastically deforming the another end portion 132 is increased. Therefore, the shape of the blade member 14 may preferably be, as shown in FIG. 6, such that the influence by the deformation is minimized, and in this embodiment, k=3.0 mm, 1=2.0 mm, m=0.5 mm and n=0.5 mm were set.

As a Comparative Embodiment, also the conventionally known cleaning member 212 was checked. FIG. 18 is a detailed structural view of the conventionally known cleaning member 212. The blade 214 is supported at an end portion of the supporting member 213 having rigidity. By the deformation of the blade 214 which is an elastic member, the cleaning contact pressure is obtained. As the material for the blade 214, the urethane rubber was used, and hardness of the blade 214 was 70 degrees in terms of JIS-A hardness. A length of a free end of the blade 214 shown in FIG. 17 was taken as L, and L was 5.2 mm. As the material for the supporting member 213, SUS material was used. The plate thickness thereof was set at 1.8 mm. The set angle between the photosensitive drum 201 and the cleaning member 212 was 30 degrees and the penetration depth was 1.05 mm. In this case, the contact pressure of the cleaning member 212 to the photosensitive drum 201 was about 35 gf per cm.

These contact pressures were subjected to deformation calculation, dynamic contact pressure was calculated. As a calculating method, applied friction was assumed and a relationship between a deformation shape and an applied force when the end portion of the cleaning member entered the photosensitive drum in one full circumference with respect to the downstream direction was calculated. Further, from the obtained forces, a component perpendicular to the surface of the photosensitive drum was taken as the contact pressure, and a component parallel to the surface of the photosensitive drum was taken as a frictional force. Further, a ratio between the contact pressure and the frictional force was obtained as a friction coefficient.

As the deformation calculation in this case, in consideration of neutral axes of the blade supporting member and the blade, a simple two-dimensional cantilever beam (assumption of Bernoulli-Euler) was used as a model and was subjected to the calculation. Incidentally, as parameters for the calculation, a longitudinal bending modulus E of the SUS plate of 167,000 MPa and a longitudinal modulus E of the urethane rubber of 6 MPa were used.

Parts (a) and (b) of FIG. 7 show the results. In these figures, the abscissa represents a coefficient of dynamic friction and the ordinate represents the contact pressure. Part (a) of FIG. 7 shows the result of Embodiment 1, and (b) of FIG. 7 shows the result of Comparative Embodiment. It can be understood that a change in contact pressure with respect to the coefficient of dynamic friction is very small in Embodiment 1 compared with Comparative Embodiment.

Parts (a) and (b) of FIG. 8 show a relationship between the coefficient of dynamic friction and the frictional force. In these figures, the abscissa represents the coefficient of dynamic friction, and the ordinate represents the frictional force. Part (a) of FIG. 8 shows the result of Embodiment 1, and (b) of FIG. 8 shows the result of Comparative Embodiment. It can be understood that a change in frictional force with respect to the coefficient of dynamic friction is small in Embodiment 1 compared with Comparative Embodiment. In Comparative Embodiment, the frictional force is accelerated-ly increased with the increase in coefficient of dynamic friction. On the other hand, in Embodiment 1, the frictional force is retained as a substantially linear increase with the increase in coefficient of dynamic friction. Also in the above-described modeling calculation, by employing the constitution of the cleaning member 12 according to the present invention, it was confirmed that stabilization of the contact pressure was able to be realized compared with the case of the conventional cleaning member.

Modified examples of the cleaning member 12 in Embodiment 1 will be described.

Parts (a) to (f) of FIG. 9 show the modified examples of the cleaning member 12 according to this embodiment.

In this embodiment, the supporting member 13 is prepared by bending the metal leaf spring as a single member. On the other hand, as shown in (a) to (d) of FIG. 9, the supporting member 13 may also be constituted by two members consisting of one end portion 131 and another end portion 132. When a constitution in which the one end portion 131 receives the blade 14 to elastically deform the another end portion 132 is taken into consideration, it can be said that the constitutions of (c) and (d) of FIG. 9 are more suitable constitutions since the two members are not readily disconnected.

Further, as shown in (e) and (f) of FIG. 9, the supporting member 13 may also be constituted by three members consisting of one end portion 131, another end portion 132 and a bent portion 133.

Next, (a) and (b) of FIG. 10 show modified examples of the blade 14 of the cleaning member 12 according to this embodiment.

In this embodiment, the supporting member 13 and the blade 14 have a constitution in which they are mounted by molding. On the other hand, as shown in (a) and (b) of FIG. 10, it is also possible to employ a constitution in which the blade 14 is bonded to the supporting member 13 by a double-side tape or a hot-melt adhesive. In this constitution, a manufacturing cost can be reduced.

Further, in (b) of FIG. 10, with respect to the movement direction of the photosensitive drum 1, the blade 14 is characterized by being provided in the upstream side of the one end portion 131 of the supporting member 13. As described above, the one end portion 131 may desirably be configured to receive the force from the blade 14 to elastically deform the another end portion 132. Therefore, by employing the constitution shown in (b) of FIG. 10, a constitution in which the supporting member 13 is not readily separated from the blade 14 when the photosensitive drum 1 is rotated can be realized.

Embodiment 2

A cleaning member 12 according to Embodiment 2 will be described.

Each of (a) to (d) of FIG. 11 shows a supporting member 13 for the cleaning member 12 in this embodiment.

In (a) of FIG. 11, the supporting member 13 constituted by the single member is characterized in that the length of the one end portion 131 is shorter than the length of the another end portion 132. In (b) of FIG. 11, the cleaning member 13 is characterized in that a curved portion 136 for increasing rigidity (strength) against bending stress of the one end portion 131 is provided. In (c) of FIG. 11, the cleaning member 13 is characterized in that a reinforcing member 135 as a separate member is provided in order to increase the rigidity of the one end portion 131.

In order to efficiently obtain an effect of this embodiment, it is desirable that a constitution in which the one end portion 131 receives the force from the blade 14 to elastically deform the another end portion 132 is employed. As in this embodiment, by increasing the rigidity of the one end portion 131, the force from the blade 14 can be satisfactorily transmitted to the another end portion 132. As a result, the another end portion 132 can be elastically deformed satisfactorily, so that the effect of the present invention can be efficiently obtained.

Further, in (d) of FIG. 11, the supporting member 13 is characterized in that one end portion 139 having rigidity is provided. In this case, the plate thickness of the one end portion 139 is 0.8 mm. By employing also this constitution, the force from the blade 14 can be satisfactorily transmitted to the another end portion 132, so that the effect of the present invention can be obtained more efficiently. Further, the one end portion 139 has the rigidity also with respect to the longitudinal direction and therefore the contact pressure can be stabilized with respect to the longitudinal direction.

Embodiment 3

A cleaning device 11 according to Embodiment 3 will be described.

FIG. 12 is a schematic illustration of the cleaning device 11 according to this embodiment.

A cleaning member 12 is fixed at a fixing portion and removes the residual toner 4, remaining after the transfer, from the photosensitive drum 1. The cleaning member 12 is constituted by a blade 14 contacted to the photosensitive drum 1 in the counter direction to the movement direction of the photosensitive drum 1, and a supporting member 13 for supporting the blade 14.

The supporting member 13 is characterized in that it supports the blade 14 and is a curve-shaped supporting member 13 having flexibility. The supporting member 13 is constituted by a blade portion supporting portion 140 where the blade 14 is provided at its end, a portion to be fixed 134 fixed at a fixing portion 153, and a bent top 137 located between the blade portion supporting portion 140 and the portion to be fixed 134. Further, the bent portion 137 is positioned in a side where it is spaced from the surface of the photosensitive drum 1 toward an outside (in a side where the bent portion 133 is moved away from the surface of the photosensitive drum 1) with respect to a line segment connecting the portion to be fixed 134 and a contact portion 138 where the blade 14 is contacted to the photosensitive drum 1. Further, the portion to be fixed 134 of the supporting member 13 is disposed downstream of the contact portion 138 with respect to the movement direction of the photosensitive drum 1, and the blade 14 is supported by only the blade portion supporting portion 140.

Further, similarly as in Embodiment 2, from the bent top 137 toward a region in an end side where the blade 14 is provided, a reinforcing portion for increasing rigidity (strength) against bending stress may also be provided. The reinforcing portion may also be the curved portion similarly as in the case of FIG. 11 and a reinforcing member which is a separate member.

By employing the constitution of Embodiment 3, the cleaning device 11 can be downsized; particularly it can be made thin. Further, it is possible to increase an accommodation volume for accommodating the residual toner. Other constitutions are the same as those in Embodiment 1. Further, the action and the effect are also the same as those in Embodiment 1.

Embodiment 4

A cleaning device 11 according to Embodiment 4 of the present invention will be described.

FIG. 13 is a schematic illustration of the cleaning device 11 according to this embodiment.

The cleaning device 11 according to this embodiment is characterized in that the charging roller 2 for charging the photosensitive drum 1 is provided in a region substantially defined by the supporting member 13 and a rectilinear line connecting the portion to be fixed 134 and the contact pressure 138 where the blade 14 is contacted to the photosensitive drum 1.

By employing the constitution in this embodiment, efficiency enhancement of a space of the cleaning device 11 can be realized, so that the cleaning device 11 can be downsized. Further, the supporting member 13 mostly covers the charging roller 2, so that charging noise of the charging roller 2 can be reduced.

INDUSTRIAL APPLICABILITY

As described above, by employing the constitution of the present invention, when the image bearing member is driven, the contact pressure can be stabilized more than that in the conventional cleaning member. That is, it becomes possible to suppress the increase in torque and the turning-up of the blade when the image bearing member is driven.

While the invention has been described with reference to the structures disclosed herein, it is not confined to the details set forth and this application is intended to cover such modifications or changes as may come within the purpose of the improvements or the scope of the following claims.

The invention claimed is:

1. A cleaning member, to be fixed at a fixing portion, for removing a developer from a surface of a member to be cleaned, said cleaning member comprising:

a blade portion contacted to the member to be cleaned with respect to a direction counter to a movement direction of the member to be cleaned; and a flexible supporting member for supporting said blade portion, said supporting member comprising one end portion where said blade portion is provided, another end portion including a portion to be fixed for being fixed at the fixing portion, and a bent portion between said one end portion and said another end portion at a side remote from a surface of the member to be cleaned toward an outside with respect to a line connecting the portion to be fixed and a contact portion where said blade portion is contacted to the member to be cleaned, wherein the portion to be fixed is provided downstream of the contact portion with respect to the movement direction of the member to be cleaned, and wherein said blade portion is supported by said supporting member in contact with only said one end portion.

2. A cleaning member according to claim 1, wherein said one end portion is configured to elastically deform said another end portion by receiving a force from said blade portion.

3. A cleaning member according to claim 1, wherein when said member to be cleaned is moved from a rest state, said bent portion is configured to be movable in a direction in which it is spaced from the surface of said member to be cleaned.

4. A cleaning member according to claim 1, wherein said one end portion and said another end portion are separate members and are connected via said bent portion provided at either one of said one end portion and said another end portion.

5. A cleaning member according to claim 1, wherein said one end portion, said another end portion and said bent portion are separate members.

6. A cleaning member according to claim 1, wherein said one end portion includes a reinforcing portion for increasing a strength against bending stress.

7. A cleaning member according to claim 6, wherein said reinforcing portion is a separate member from said one end portion.

8. A cleaning member according to claim 1, wherein said blade portion is provided at an upstream side of said one end portion with respect to the movement direction of said member to be cleaned.

9. A cleaning member according to claim 1, wherein said supporting member is a leaf spring of metal.

10. A cleaning device for use with an image forming apparatus, comprising:

a fixing portion provided on a frame;

a cleaning member according to claim 1; and an accommodating portion for accommodating the developer removed from said member to be cleaned.

11. A process cartridge detachably mountable to an image forming apparatus, comprising:

an image bearing member which is said member to be cleaned;

a fixing portion provided on a frame; and a cleaning member according to claim 1.

12. A process cartridge according to claim 11, wherein said image bearing member is a photosensitive drum.

13. A process cartridge according to claim 11, wherein said process cartridge includes a charging member for electrically charging said image bearing member, and wherein said blade portion is provided in a region defined by said supporting member and a rectilinear line connecting the portion to be fixed and the contact portion contacted to said image bearing member.

14. An image forming apparatus for forming an image on a recording material, comprising:

said member to be cleaned;

a fixing portion; and a cleaning member according to claim 1.

15. An image forming apparatus according to claim 14, wherein said member to be cleaned is a photosensitive member for forming a developer image.

16. An image forming apparatus according to claim 14, wherein said member to be cleaned is an intermediary transfer member onto which a developer image is to be transferred.

17. An image forming apparatus according to claim 14, wherein said member to be cleaned is a conveying member for conveying the recording material.

18. An image forming apparatus according claim 14, wherein said image forming apparatus is capable of forming a color image.

19. A cleaning member, to be fixed at a fixing portion, for removing a developer from a surface of a member to be cleaned, said cleaning member comprising:

a blade portion contacted to the member to be cleaned with respect to a direction counter to a movement direction of the member to be cleaned; and a flexible curved supporting member for supporting said blade portion, said supporting member comprising a blade portion supporting portion where said blade portion is provided at an end side of the blade portion supporting portion, a portion to be fixed for being fixed at the fixing portion, and a bent top between said blade portion supporting portion and said portion to be fixed at a side remote from a surface of the member to be cleaned toward an outside with respect to a line connecting the portion to be fixed and a contact portion where said blade portion is contacted to the member to be cleaned, wherein the portion to be fixed is provided downstream of the contact portion with respect to movement direction of the member to be cleaned, and wherein said blade portion is supported by said supporting member in contact with only said blade portion supporting portion.

20. A cleaning member according to claim 19, wherein when said member to be cleaned is moved from a rest state, said bent top is configured to be movable in a direction in which it is spaced from the surface of said member to be cleaned.

21. A cleaning member according to claim 19, wherein a reinforcing portion for increasing a strength against bending stress is provided in a region ranging from said bent top toward the end side.

22. A cleaning member according to claim 21, wherein said reinforcing portion is a separate member from said supporting member.

23. A cleaning member according to claim 19, wherein said blade portion is provided at an upstream side of said blade portion supporting portion with respect to the movement direction of said member to be cleaned.

24. A cleaning member according to claim 19, wherein said supporting member is a leaf spring of metal.

25. A cleaning device for use with an image forming apparatus, comprising:

a fixing portion provided on a frame;

a cleaning member according to claim 19; and an accommodating portion for accommodating the developer removed from said member to be cleaned.

26. A process cartridge detachably mountable to an image forming apparatus, comprising:

an image bearing member which is said member to be cleaned;

a fixing portion provided on a frame; and a cleaning member according to claim 19.

27. A process cartridge according to claim 26, wherein said image bearing member is a photosensitive drum.

28. A process cartridge according to claim 26, wherein said process cartridge includes a charging member for electrically charging said image bearing member, and wherein said blade portion is provided in a region defined by said supporting member and a rectilinear line connecting the portion to be fixed and the contact portion contacted to said image bearing member.

29. An image forming apparatus for forming an image on a recording material, comprising:

said member to be cleaned;

a fixing portion; and a cleaning member according to claim 19.

30. An image forming apparatus according to claim 29, wherein said member to be cleaned is a photosensitive member for forming a developer image.

31. An image forming apparatus according to claim 29, wherein said member to be cleaned is an intermediary transfer member onto which a developer image is to be transferred.

32. An image forming apparatus according to claim 29, wherein said member to be cleaned is a conveying member for conveying the recording material.

33. An image forming apparatus according to claim 29, wherein said image forming apparatus is capable of forming a color image.

* * * * *